US005584107A

United States Patent [19]

Koyanagi et al.

[11] Patent Number: 5,584,107

[45] Date of Patent: Dec. 17, 1996

[54] BUCKLE DEVICE FOR INFANT RESTRAINING SEAT

[75] Inventors: Toshiro Koyanagi, Hikone; Koji Hiramatsu, Oumihachiman; Osamu Nakagawa, Higashiasai-gun, all of Japan

[73] Assignee: Takata Corporation, Tokyo, Japan

[21] Appl. No.: 503,015

[22] Filed: Jul. 17, 1995

[30] Foreign Application Priority Data

Sep. 6, 1994 [JP] Japan ..... 6-238562

[51] Int. Cl.[6] ..... A44B 11/00

[52] U.S. Cl. ..... 24/632; 24/637; 24/643

[58] Field of Search ..... 24/632, 633, 634, 24/635, 636, 637, 643, 644; 297/468

[56] References Cited

U.S. PATENT DOCUMENTS 5,023,981 6/1991 Anthony et al. ..... 24/632
5,142,748 9/1992 Anthony et al. ..... 24/632
5,269,051 12/1993 McFalls ..... 24/637
5,283,933 2/1994 Wiseman et al. ..... 24/632
5,373,612 12/1994 Kopetzky ..... 24/637

*Primary Examiner*—Victor N. Sakran
*Attorney, Agent, or Firm*—Kanesaka & Takeuchi

[57] ABSTRACT

A buckle device for an infant restraining seat of the present invention includes: a frame member which has a base plate and side plates; an engaging member which is pivotally supported by supporting members formed in the side plates of the frame member and is capable of engaging a pair of tongue plates inserted into the buckle; and a blocking plate which is rotatably supported on the base plate of the frame member and has a blocking member for preventing the pivotal movement of the engaging member when the blocking plate rotates. When only one of the pair of tongue plates is inserted into the buckle, the blocking plate rotates by the insertion of the one of the tongue plates. The blocking member thereby prevents the pivotal movement of the engaging member so as to prevent engagement between the engaging member and the one of the tongue plates. Therefore, it can prevent the false latching between the tongue plates and the buckle.

6 Claims, 12 Drawing Sheets

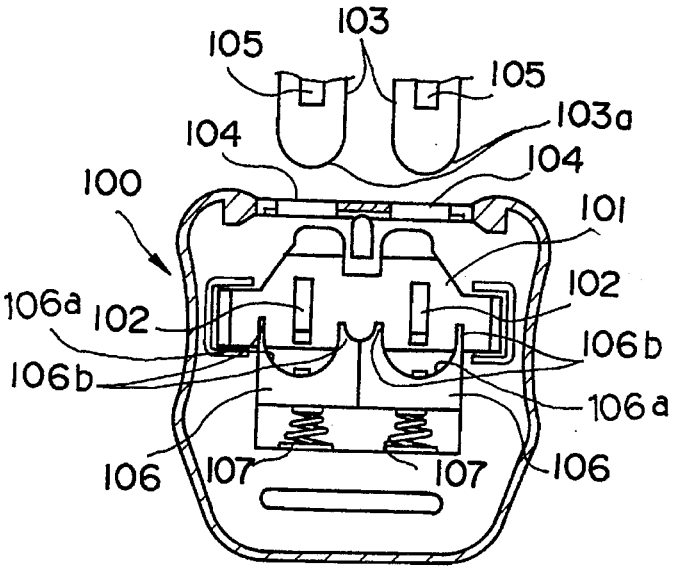
Fig. 1 (a) PRIOR ART
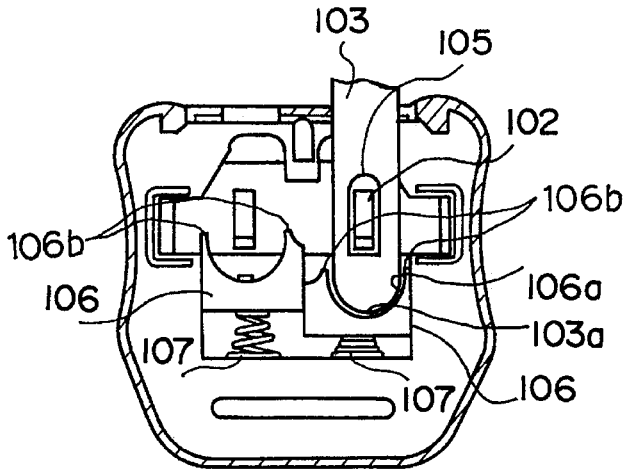
Fig. 1 (b) PRIOR ART

BUCKLE DEVICE FOR INFANT RESTRAINING SEAT

BACKGROUND OF THE INVENTION

The present invention relates to a buckle device for an infant restraining seat, more particularly, to a buckle, used in a seat belt device of an infant restraining seat, which provides secure latching with a pair of tongues only when the both tongues are inserted therein simultaneously.

For safely securing an occupant when a vehicle comes into collision, various kinds of safety devices have been developed. A seat belt device is one of such safety devices. A seat belt device mounted inside a vehicle is generally designed to fit the length of a webbing thereof and its mounting position for an adult body similarly to a size of a seat. Hence, infant restraining seats are developed as means for effectively securing a child, particularly an infant.

In a typical infant restraining seat, movement of an infant sitting in a seat is restrained by an infant seat belt device. According to the infant restraining seat, the infant is restrained by softly holding the chest of the infant with a pad as a chest protector and a buckle with a large area. In addition, the infant is restrained by two shoulder belts holding areas from the both shoulders to the chest of the infant. The lower end of the buckle is fixed to a seat base by a crotch belt, the width of which is relatively large. The crotch belt restricts the buttocks of the infant from moving forward.

As for an infant seat belt device of this kind, for putting the seat belt to an infant, it is preferable that tongues of the shoulder belts are quickly connected to a buckle when the infant is seated.

However, even when tongue plates of the tongues are inserted into the tongue through holes, the tongues can not be latched sometimes when either of the tongues is insufficiently inserted or an object enters inside the buckle device. Therefore, there is a possibility that the tongues and the buckle are remained in a state in which engaging holes of the tongue plates and latch members are incompletely engaged (hereinafter, referred to as "the false latched state").

Each tongue is mounted to an end of each of the two shoulder belts. Therefore, it is necessary that the tongues are latched only when a pair of tongues are inserted to the buckle completely.

A buckle device for an infant restricting seat which solved such a problem is disclosed in U.S. Pat. No. 5,142,748 (hereinafter, referred to as "the conventional buckle").

FIGS. 1(*a*) and 1(*b*) are sectional views showing an operational state of an anti-false latching mechanism of the conventional buckle.

As shown in FIG. 1(*a*), a latch plate 101 which is formed in an oblong shape and is pivotally supported by a spring (not shown) is accommodated in a cover of the buckle 100. The latch plate 101 is provided with two wedge-shaped latch pawls 102 protruding from the surface thereof. When tongue plates 103 are inserted into tongue through holes 104 of the buckle 100, the latch pawls 102 engage engaging holes 105 of the tongue plates 103 to prevent the tongues from coming off. In the initial state, the latch plate 101 is urged by the biasing force of the aforementioned spring to latch the tongue plates.

Two ejectors 106 supported by ejector springs 107 are accommodated in the buckle 100. Ends 103*a* of the tongue plates 103 come in contact with the ejectors 106 when the tongue plates 103 are inserted into the buckle. The ejectors 106 have concave, arc-like portions 106*a*, respectively, so as to fit with the shape of the ends 103. As the ends 103*a* of the tongue plates 103 come in contact with the arc-like portions 106*a* and push the ejectors 106, the ejectors 106 are shoved to slide rearwardly against the biasing force of ejector springs 107.

The arc-like portions 106*a* are provided with elongated portions 106*b* at both ends thereof. The ends of the elongated portions 106*b* lie on the top of the latch plate 101, thereby preventing the latch plate 101 from pivoting to a position whereat the latch plate latches the tongues even though the latch plate 101 is urged by the biasing force of the latch spring (not shown).

In the initial state as shown in FIG. 1(*a*), as the tongue plates 103 are arranged and inserted into the tongue through holes 104, the two ejectors 106 are pushed by the ends 103*a* of the tongue plates 103 to move rearwardly simultaneously. Therefore, the latch plate 101 is released from the state in which the pivotal movement is prevented by the elongated portions 106*b*. As a result, the latch plate 101 pivots to the position whereat the latch plate latches the tongues so that the tongues are latched by the latch plate 101.

When one of the tongue plates 103 is inserted into the tongue through hole 104, only the corresponding ejector 106 is pushed to slide rearwardly (See FIG. 1(*b*)). Then, the holding of the latch plate 101 by the elongated portions 106*b* is released. However, the elongated portions 106*b* of the other ejector 106 corresponding to the tongue plate not inserted still prevents the pivotal movement of the latch plate 101. Therefore, the latch plate 101 does not pivot to the position whereat the latch plate latches the tongue plates 103. The buckle is not latched when only one of the tongue plates 103 is inserted into the tongue through hole 104 of the buckle.

However, in the conventional buckle, the elongated portions 106*b* of the ejectors 106 always restrict the pivotal movement of the latch plate 101 by holding the latch plate 101. Therefore, when the tongue plates 103 are inserted into the tongue through holes to push the ejectors 106 with the ends thereof, the tongue plates 103 are not smoothly inserted because the elongated portions 106*b* and the latch plate 101 rub together.

Also when releasing the tongues from the buckle, the tongues can not be smoothly ejected sometimes because the latch spring (not shown) pushes the latch plate 101.

SUMMARY OF THE INVENTION

Therefore, an object of the present invention is to solve the above mentioned problems of the prior art and to provide a buckle for an infant restraining seat which allows smooth insertion and release of tongues and allows secure latching operation between the tongues and the buckle at the same time when the tongues are inserted.

For achieving the above mentioned object, the present invention provides a buckle for an infant restraining seat comprising: a frame member which has a base plate and side plates; an engaging member which is pivotally supported by supporting members formed in the side plates of the frame member and is capable of engaging a pair of tongue plates inserted into the buckle; and a blocking plate which is rotatably supported on the base plate of the frame member and has a blocking member for preventing the pivotal movement of the engaging member when the blocking plate rotates. When only one of the pair of tongue plates is inserted into the buckle, the blocking plate rotates by the insertion of the one of the tongue plates. Therefore, the blocking member prevents the pivotal movement of the engaging member so as to prevent engagement between the engaging member and the one of the tongue plates.

According to one embodiment of the present invention, a buckle for an infant restraining seat comprises: a frame member which has a base plate and side plates; an engaging member which is pivotally supported by supporting members formed in the side plates of the frame member and is capable of engaging a pair of tongue plates inserted into the buckle; a blocking plate which is rotatably supported on the base plate of the frame member substantially at the center in the width direction and has arms extending on both sides from near the center in the width direction and blocking members formed on ends of the arms for preventing the pivotal movement of the engaging member when the blocking plate rotates; a pair of ejectors which are slidably supported by the frame member and are disposed at positions to come in contact with the pair of tongue plates, respectively; and a pair of ejector springs which are disposed between the arms and the ejectors in the compressed state, each one end being fixed to the arms of the blocking plate and each the other ends being fixed to back surfaces of the ejectors. When only one of the pair of tongue plates is inserted into the buckle, the pushing force by the insertion of the one of the tongue plates is transmitted to the corresponding one of the arms of the blocking plate through one ejector and one ejector spring, and the blocking plate rotates around the center by the pushing force. Therefore, either blocking member prevents the pivotal movement of the engaging member so as to prevent engagement between the engaging member and the one of the tongue plates.

According to another embodiment of the present invention, a buckle for an infant restraining seat comprises: a frame member which has a base plate and side plates; an engaging member which is pivotally supported by supporting members formed in the side plates of the frame member and is capable of engaging a pair of tongue plates inserted into the buckle; a blocking plate which is rotatably and slidably supported on the base plate of the frame member substantially at the center in the width direction, and has arms extending on both sides from near the center in the width direction and having contact portions where the ends of the tongue plates come in contact with and a blocking member for allowing the pivotal movement of the engaging member when the blocking plate moves slidably in the insertion direction of the tongue plates and for preventing the pivotal movement of the engaging member when the blocking plate rotates; and at least one ejector spring for biasing the blocking plate in the discharge direction of tongue plates, one end of which is fixed to the blocking plate and the other end of which is fixed to the base flame. When only one of the pair of tongue plates is inserted into the buckle, the corresponding one of the arms of the blocking plate is pushed by the insertion of the one of the tongue plates, and the blocking plate rotates around the center by the pushing force. Therefore, the blocking member prevents the pivotal movement of the engaging member so as to prevent engagement between the engaging member and the one of the tongue plates.

In the aforementioned another embodiment of the present invention, the blocking member of the blocking plate is a protrusion protruding from the center of the blocking plate.

BRIEF DESCRIPTION OF THE DRAWINGS

FIG. 1(*a*) is a view for explaining the initial state of an anti-false latching mechanism of a conventional buckle;

FIG. 1(*b*) is a view for explaining a state of the anti-false latching mechanism of the conventional buckle, in which one of tongues is inserted;

DETAILED DESCRIPTION OF THE PREFERRED EMBODIMENTS

Referring to the attached drawings, the following description will be made as regard to the first embodiment of a buckle for an infant restraining seat according to the present invention.

Figure 2:
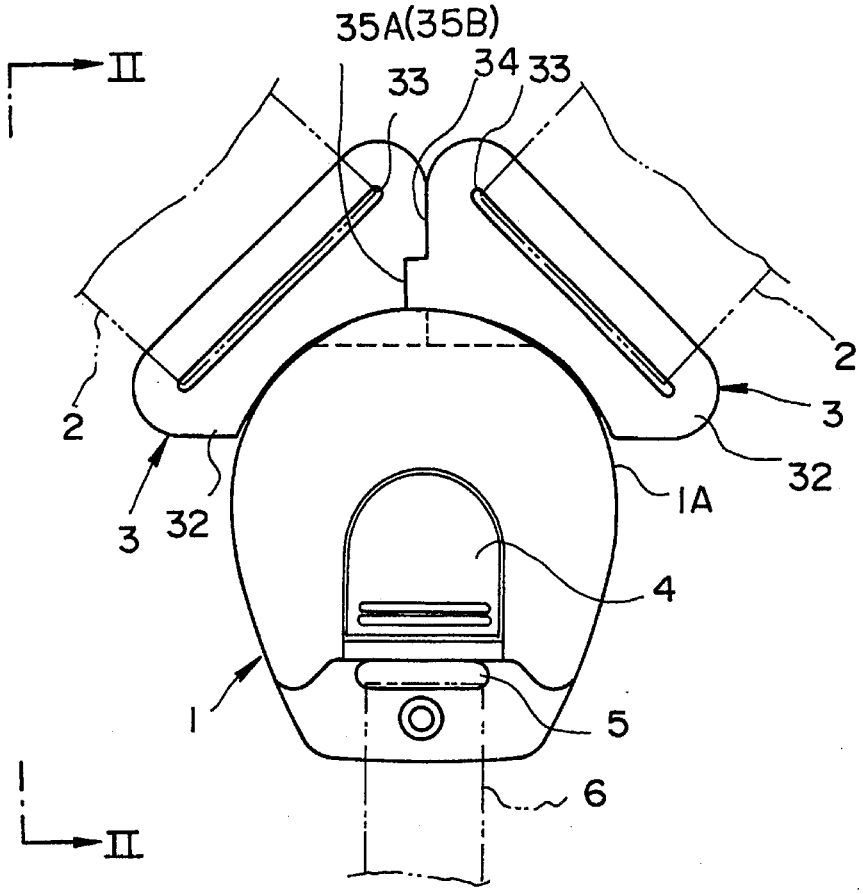
FIG. 2 is a front view showing a whole buckle for an infant restraining seat of a first embodiment according to the present invention.

FIG. 2 is a front view showing the front shape of a buckle used in an infant seat belt device for an infant restraining seat.

The buckle 1 has a resin upper cover 1A, an upper half of which is formed in a flat disk-like shape. This figure shows a state in which tongues 3 fixed to ends of shoulder belts 2 are inserted into tongue through holes (not shown) formed in an upper end of the buckle 1.

The upper cover 1A is cut away at a central portion of the front surface thereof. A push button 4 is disposed in this cut-away portion. The push button 4 is a part of a button plate 60 (described later) accommodated in the upper cover 1A. By pressing the push button 4, the latching of the tongues 3 connected to the buckle i is released. Further, after release of the latching, the tongues 3 can be securely separated from the body of the buckle 1 by ejecting operation.

The upper cover 1A is also provided with a crotch belt fitting aperture 5 which is oblong and disposed below the push button 4. An end of a crotch belt 6 is inserted through the crotch belt fitting aperture 5. The end of the crotch belt 6 is turned back at the crotch belt fitting aperture 5.

Figure 4:
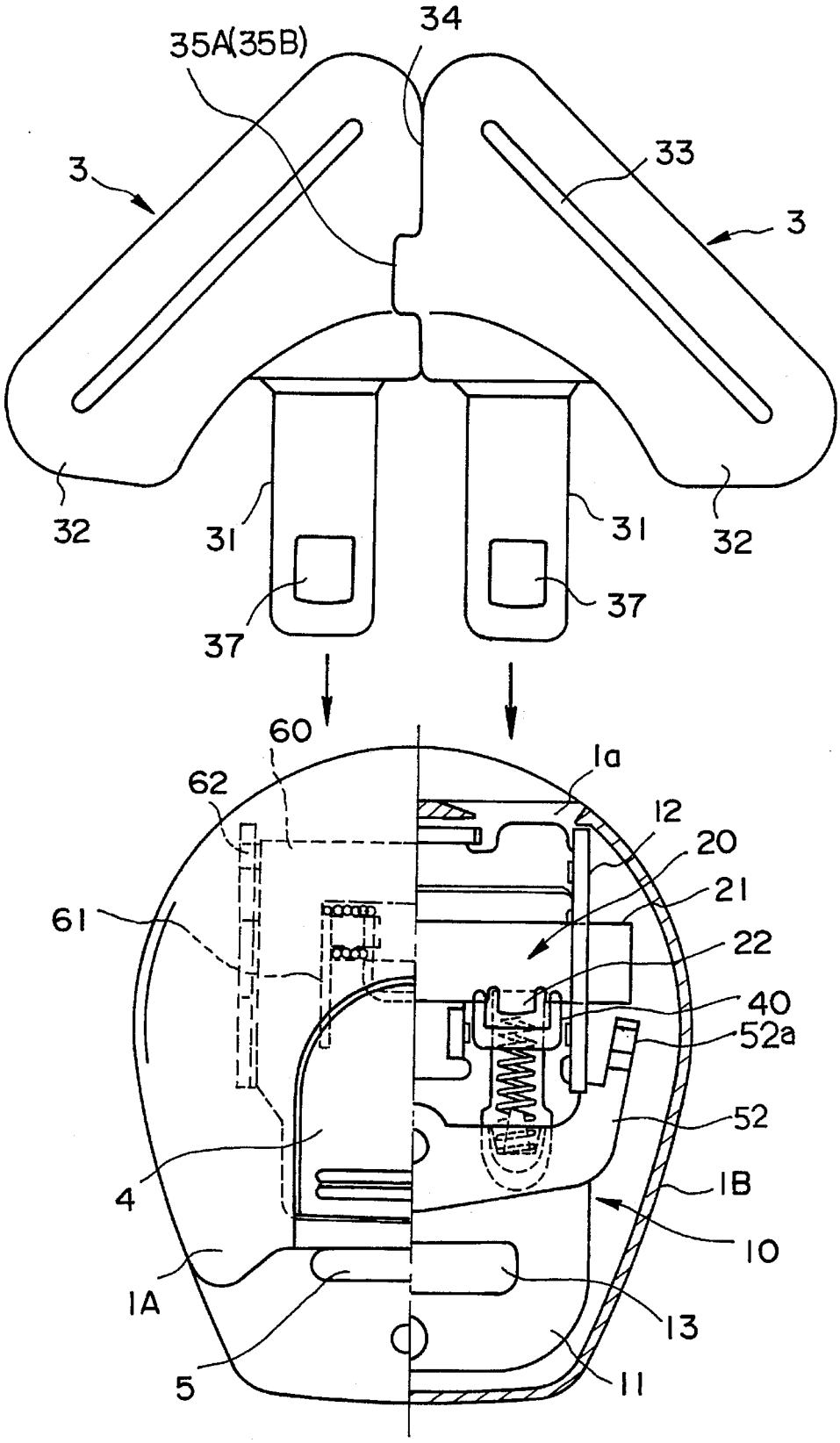
FIG. 4 is a partially sectional view of the buckle shown in FIG. 2 which is partially cut away for explaining the inside thereof.

On the other hand, the tongues 3 to be interconnected to the upper end of the buckle 1 comprise tongue plates 31 made of steel as shown in FIG. 4. The tongue plates 31 have handles 32 formed by coating a base portion of the tongue plates 31. The shape of the handle 32 is substantially triangular in its plan view. Each handle 32 is provided with a webbing through hole 33 tilting at an angle of approximately 45° to the direction of inserting the tongue plate 31 (hereinafter, referred to as "the tongue insertion direction"). Webbings are turned back at the webbing through holes 33 to form shoulder belts 2, respectively (see FIG. 2).

Figure 3:
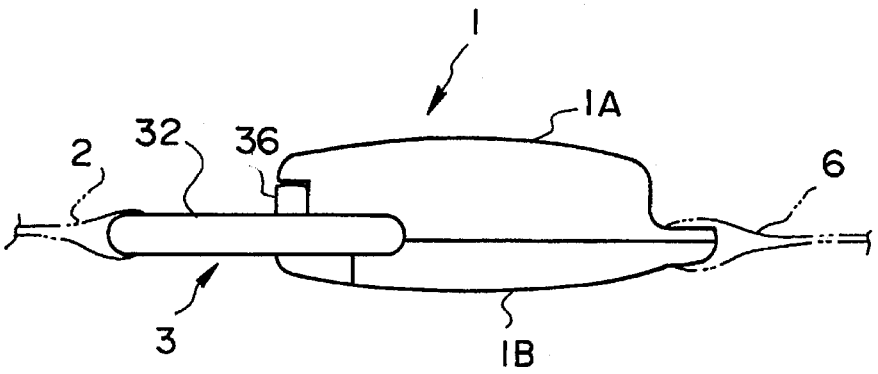
FIG. 3 is a side view of the buckle shown in FIG. 2.

Matching faces of both tongues 3, 3 have liner guide faces 34. A concave portion 35A and a convex portion 35B corresponding to the concave portion 35A are formed at the central portions of the guide faces respectively. As shown in FIG. 3, a pair of tongues 3 and 3 are thereby matched with each other at the concave and convex portions 35A, 35B so that both of the tongues 3 and 3 are inserted into the buckle 1 at a time. Even though one of the tongues 3 is tried to be inserted when the other one of the tongues 3 was already inserted (it should be noted that the tongue plate 31 of only one of the tongues is not allowed to be latched), the concave and convex portions 35A, 35B prevent the tongue 3 from being inserted.

That is, by providing the concave and convex portions 35A, 35B the tongues 3 are connected to the buckle 1 only when both of the tongues 3 and 3 are inserted to the buckle 1 at a time.

FIG. 3 is a side view of the buckle 1 shown in FIG. 2. As shown in this figure, the buckle 1 comprises the upper cover 1A formed in a shape to cover a whole tongue latching mechanism accommodated therein and a lower cover 1B. The upper cover 1A and the lower cover 1B are integrated by screws to form a buckle cover. The lower cover 1B is provided with a partition (not shown) formed on the inner surface thereof. The partition supports and fixes a base frame in a predetermined position. The tongue latching mechanism and a blocking plate for preventing the false latching are mounted to the base frame.

The tongue handles 32 of the tongues 3 are each provided with a guide projection 36. The buckle 1 is provided with a cutout formed on the tongue through holes 1*a*. The size of the cutout is designed to accommodate a combination of the guide projections 36. The guide projections 36 prevent the tongue plates 31 from being inserted inside out, thereby preventing the twisting of the webbing of the shoulder belt 2 at the time of inserting the tongue plates 31.

FIG. 4 is a front view showing the buckle 1 which is partly cut away.

In this figure, a base frame 10 as a frame member fixed on the lower cover 1B, a latch plate 20 as an engaging member pivotally supported by the base frame 10 to engage the right-side tongue 3 inserted into the buckle 1, one of ejectors 40 for separating and discharging the tongue 3 from the buckle 1 when taking off the seat belt, and a blocking plate 50 as an anti-false latching member for preventing the false latching of the tongue plate 31 are shown in the right-half section of the buckle 1. In the above and following description, directions such as right and left are represented in a condition the buckle 1 is seen from its front).

On the other hand, the upper cover 1A forming the profile of the buckle 1 and a push button 4 for releasing the locking of the tongue are shown in the left-half section of the buckle 1 by solid lines. A button plate 60 in which the push button is integrally formed and a latch spring 61 as a biasing member are also shown in the left-half section by dotted lines.

This description will now be made as regard to the details of components to be mounted to the base frame 10, referring to FIG. 5, and to the operation for preventing the false latching by the components, referring to FIG. 6(*a*) through FIG. 9(*b*).

Figure 5:
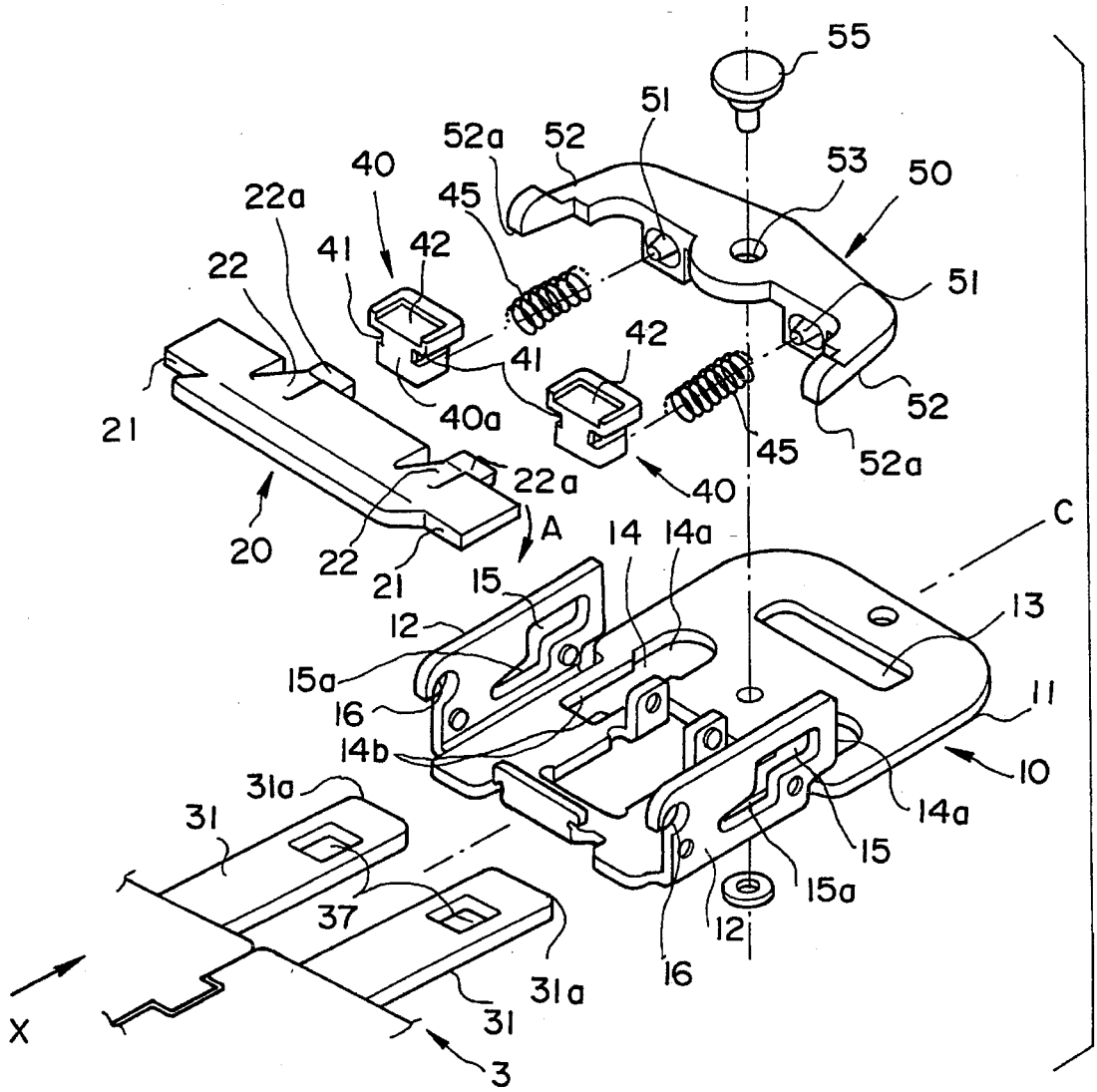
FIG. 5 is an exploded, perspective view showing main components of an anti-false latching mechanism of the first embodiment.

As shown in FIG. 4 and FIG. 5, the base frame 10 comprises a base plate 11 formed substantially in rectangle and side plates 12. The base frame 10 are made by punching a steel plate and then processed by bending. The base frame 10 is formed in a T-like shape in its development view. The both side plates 12 are bent upwardly so that the base frame 10 is formed in a U-like shape as seen in the direction of the arrow X in FIG. 5.

The base plate 11 is provided with a crotch belt fitting aperture 13 and ejector guide apertures 14 along the tongue insertion direction, formed by punching. Each ejector guide aperture 14 has a wide portion 14*a* formed on one end thereof. Thereby, the ejectors 40 can be inserted from the wide portions 14*a* so that the ejectors 40 are fitted to the ejector guide apertures 14, respectively. The ejectors 40 fitted in such a manner are capable of sliding in tongue insertion direction along aperture edges 14*b* of the ejector guide apertures 14.

The side plates 12 are provided with supporting holes 15, respectively, so that the supporting holes 15 are symmetric with respect to the center line C. Each supporting hole 15 is provided with a V-shaped opening portion 15*a* and is formed in a Z-like shape. Tabs 21 disposed on both sides of the latch plate 20 are supported by the supporting holes 15 so that the latch plate 20 can pivot in a predetermined range.

The side plates 12 are provided with cutouts 16, respectively, formed at the upper edge side of the side plates 12. Shafts 62 of the button plate 60 are pivotally supported by the cutouts 16 (see FIG. 4).

Each ejector 40 to be fitted in each ejector guide aperture 14 is a resin molding product formed in a rectangular solid shape. Each ejector 40 is provided with guide grooves 41 on the sides thereof. By fitting the guide grooves 41 of each ejector 40 to the aperture edges 14*b* from each wide portion 14*a*, the ejector 40 can slide along the aperture edges 14*b* in the ejector guide apertures 14.

The ejectors 40 are provided with concaves (not shown) on the back surfaces thereof, respectively. Each of the ejector spring 45 has ends, one of which is fitted to the concave, and the other of which is fixed to each of conical protrusions 51 of the blocking plate 50. Therefore, when the tongues are not inserted, both of the ejectors 40 are biased to be positioned at the tongue through hole 1*a* side in the ejector guide apertures 14 (see FIG. 4).

A front surface 40*a* of each ejector 40 is positioned to come in contact with an end 31*a* of the tongue plate 31 of the corresponding tongue 3. When the tongue plates 31 are inserted into the buckle 1, the ejector springs 45 are compressed. On the other hand, when the tongues 3 are released from the lock, the ejector springs 45 expand to push out the tongue plates 31, thereby securely discharging the tongues 3 from the buckle 1.

Tabs 21 on the both sides of the latch plate 20 are pivotally supported in the supporting holes 15. The latch plate 20 is made of a steel plate. The latch plate 20 has latch pawls 22 integrally formed there with at portions where the tongue plates 31 are inserted. The latch pawls 22 are formed by slightly bending parts of the latch plate 20, both edges of which are made by slitting the latch plate 20.

The latch paw is 22 engage the engaging holes 37 formed in the tongue plates 31, with the result that the tongue plates 31 can be securely latched to the buckle 1.

In the initial state (in which the tongues are not inserted; FIG. 4 and FIGS. 6(*a*), 6(*b*)), the latch plate 20 is biased by a latch spring 61, not shown, in the direction of the arrow A (FIG. 5). Then, ends 22*a* of the latch pawls 22 are in contact with concaves 42 formed on the upper surfaces of the ejectors 40, respectively. The ends 22*a* of the latch pawls 22 biased by the spring are supported by the parts of the ejectors 40, thereby preventing failing to eject the tongues 3 from buckle 1 when the tongues 3 are released from the locking.

The description will now be made as regard to the blocking plate 50, referring to FIG. 5, FIGS. 6(*a*) and 6(*b*)

.

The blocking plate 50 is a resin molding product formed in an angular U-like shape in its plan view, made of a single material, having arms 52 which are symmetric. The blocking plate 50 is provided with a hole 53 formed at the substantially central portion thereof, into which a pin 55 is fitted to mount the blocking plate 50 rotatably to the base plate 11. When the blocking plate 50 rotates, either of blocking portions 52*a* at the ends of the right and left arms 52 slips into a space below the tabs 21 formed at the end of the latch plate 20 to push up the plate 20.

The description will now be made as regard to the operation of the blocking plate 50 for preventing a false latching, referring to FIG. 6(*a*) through FIG. 9(*b*).

Figure 6:
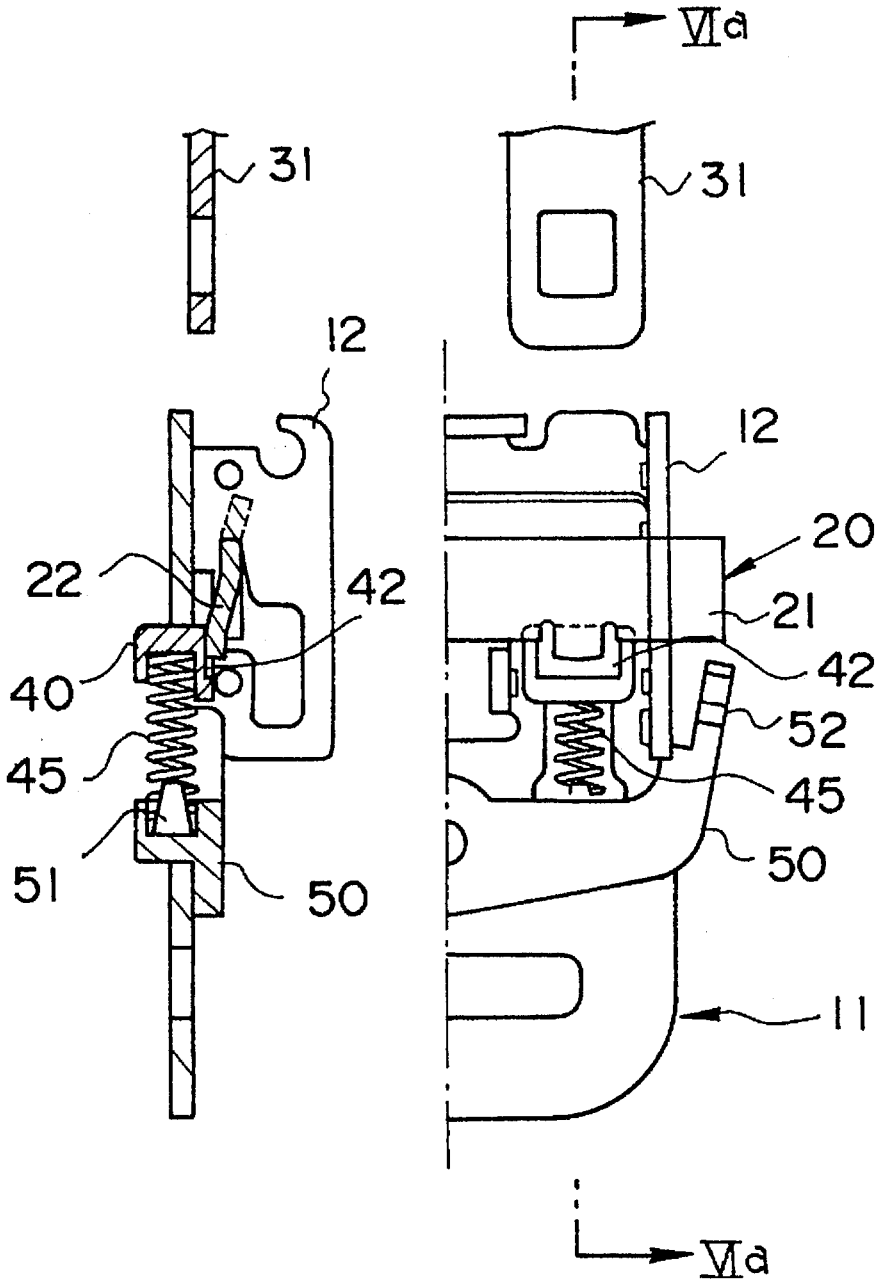
FIGS. 6(*a*) and 6(*b*) are views for explaining the operational state of the anti-false latching mechanism shown in FIG. 5 (before insertion of tongues)

As shown in FIG. 6(*a*), when the tongue plates 31 are not inserted, the ejector springs 45 are in the expanded state. The ends 22*a* of the latch pawls 22 are in contact with the concaves 42 disposed on the upper surfaces of the ejectors 40. The expansions of the right and left ejector springs 45 are equal to each other.

This means that the angular moments about the pin 55 which are applied to the blocking plate 50 by the right and left ejector springs 45 balance. Thereby, the blocking plate 50 is kept to be at a right angle to the tongue insertion direction.

Figure 7:
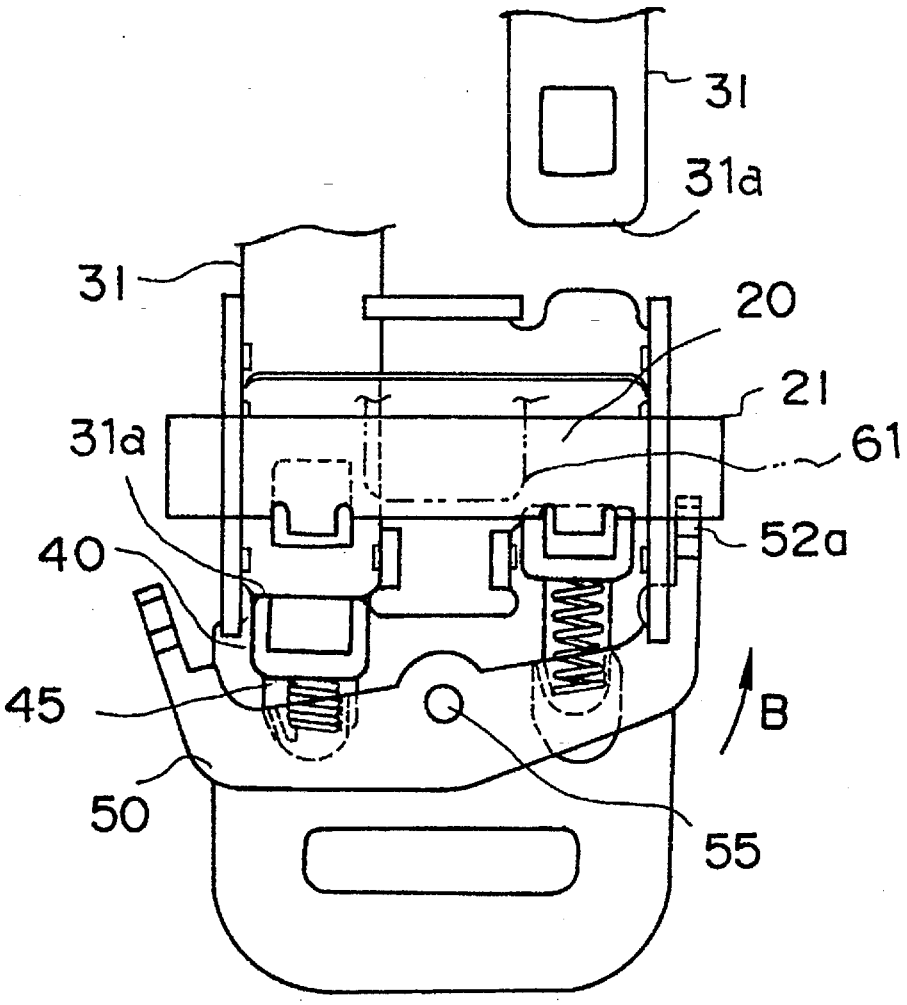
FIGS. 7 is a view for explaining the operational state of the anti-false latching mechanism shown in FIG. 5 (after insertion of one of the tongues)
Figure 8:
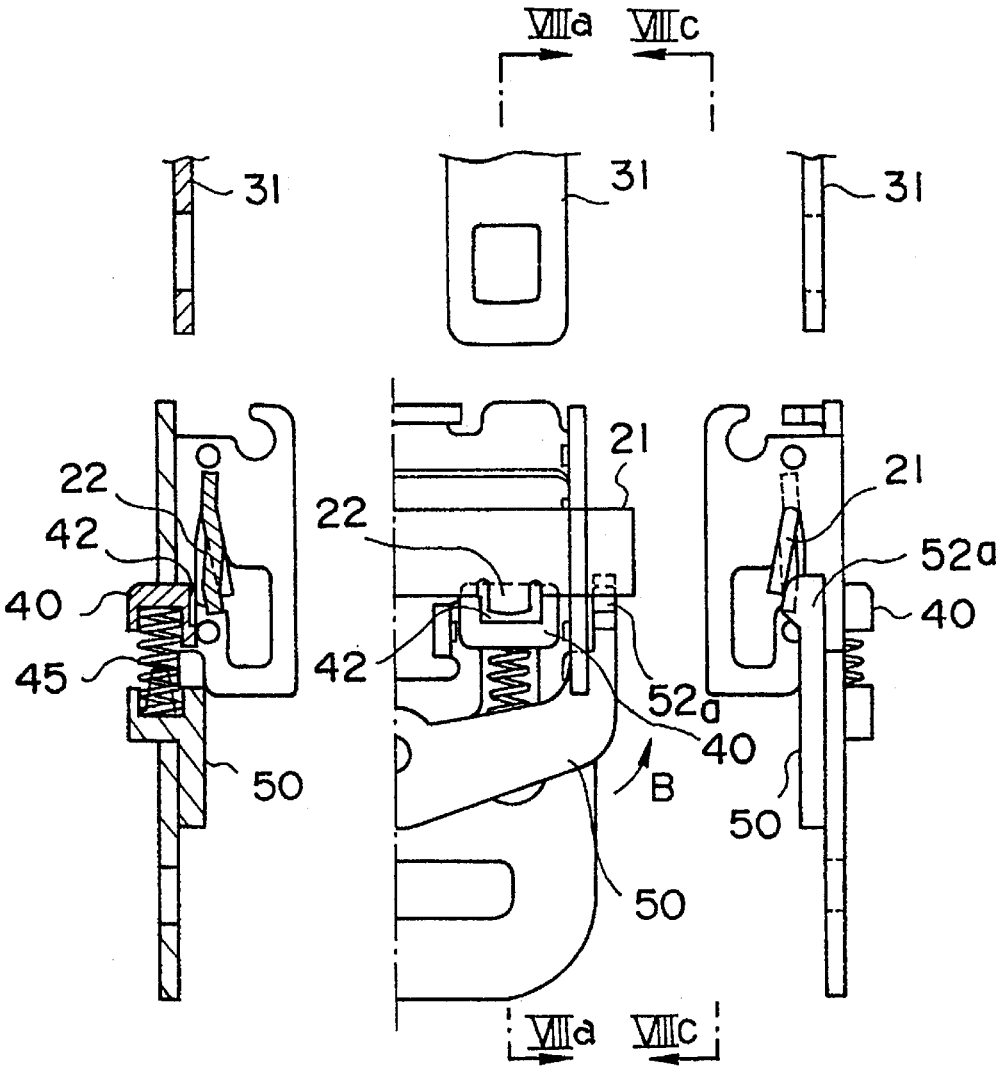
FIGS. 8(*a*), 8(*b*) and 8(*c*) are views for explaining the operational state of the anti-false latching mechanism shown in FIG. 5 (after insertion of one of the tongues)

The description will now be made as regard to a case where only one of the tongues 3 (as an example, the left side tongue in FIG. 7) is inserted into the buckle 1. As shown in FIG. 7 and FIGS. 8(*a*)–8(*c*), the tongue plate 31 is inserted along an introducing path and then an end 31*a* of the tongue plate 31 comes in contact with the ejector 40. The ejector spring 45 is thereby compressed so that the ejector 40 is pushed rearwardly. This pushing force rotates the blocking plate 50 in the direction of the arrow B so that the blocking member 52*a* of the arm 52 at the other side slips into the space below the tab 21 of the latch plate 20 (see FIG. 8(*b*), 8(*c*)). The latch plate 20 thereby moves rising the tab 21 of the latch plate 20 against the latch spring 61. As shown in FIG. 8(*a*), the latch pawl 22 is then kept apart from the concave 42 of the ejector 40, thereby preventing latching when only one of the tongue plates 31 is inserted to the buckle 1.

Figure 9:
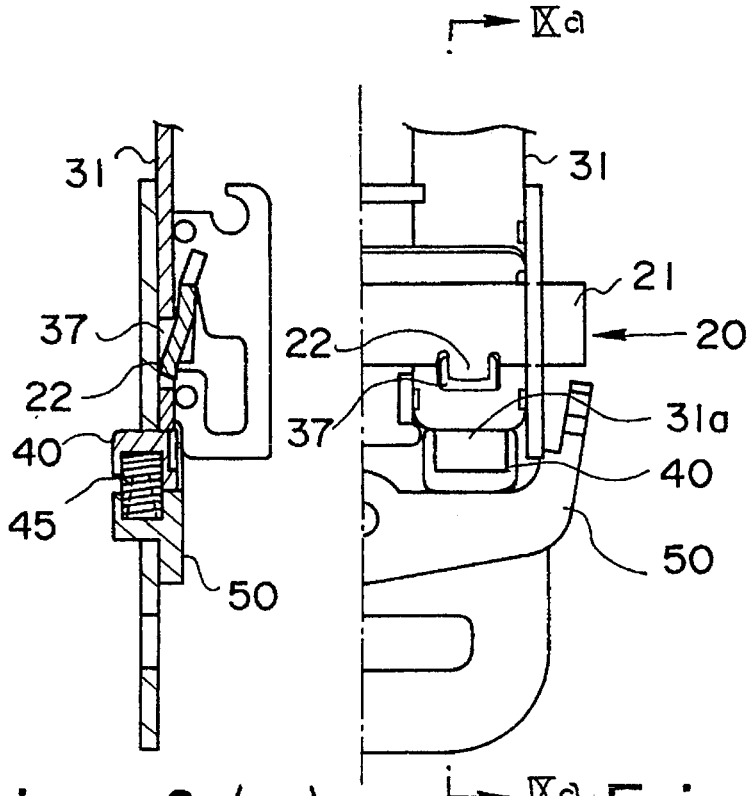
FIGS. 9(*a*) and 9(*b*) are views for explaining the operational state of the anti-false latching mechanism shown in FIG. 5 (after insertion of both of the tongues)

While, as the both tongues are inserted into the tongue through holes of the buckle at a time, as shown in FIGS. 9(*a*) and 9(*b*), the right and left ejectors 40 equally push and compress the ejector springs 45. The blocking plate 50 does not rotate in either direction and the ejectors 40 are pushed rearwardly. Thereby, the latch plate 20 pivots to the position whereat it can latch the tongues. At this point, the latch pawls 22 of the latch plate 20 engage the engaging holes 37 of the tongue plates 31, respectively. The tongue plates 31 is prevented from coming off because the latch plate 20 is biased by the latch spring (not shown).

The second embodiment will now be described referring to FIG. 10 through FIG. 13. The description will be omitted in part by using same reference numerals for designating the same parts as those of the first embodiment.

Figure 10:
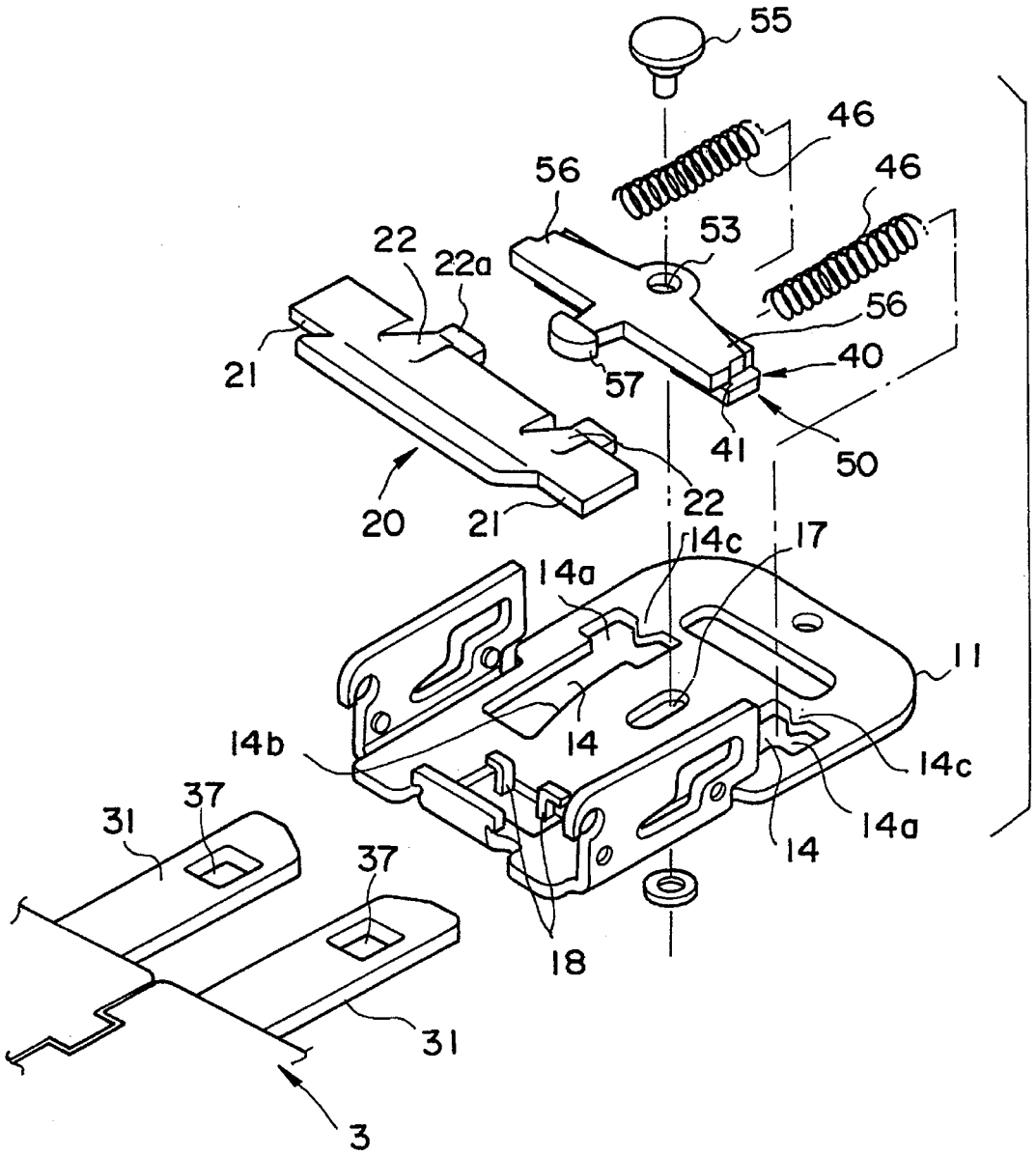
FIG. 10 is an exploded, perspective view showing main components of an anti-false latching mechanism of a second embodiment.

As shown in FIG. 10, a base plate 11 is provided with two ejector guide apertures 14 formed along the tongue insertion direction. Each ejector guide aperture 14 has a rough-rectangular wide portion 14*a*, for fitting ejectors 40, formed at one end thereof. Each wide portion 14*a* is provided with a rough-triangular protrusion 14*c* formed on the end face thereof to fix each one end of ejector springs 48. The other ends of the ejector springs 48 are fixed to spring receiving portions (not shown) in the ejectors 40 formed integrally with a blocking plate 50 on the bottom surface thereof.

The description will now be made as regard to the configuration of the blocking plate 50 in which the ejectors 40 are formed integrally. As shown in FIG. 10, the blocking plate 50 is a resin molding product, made of a single material, provided with plate arms 56 and a central protrusion 57 to be formed together in a T-like shape in plan. The blocking plate 50 is provided with a hole 53 at the substantially central portion thereof. The blocking plate 50 is rotatably mounted to the base plate 11 by inserting a pin 55 into the hole 53 and an elongated hole 17 formed in the base plate 11. Because the pin 55 is supported in the elongated hole 17, the blocking plate 50 is capable of sliding only in a range of a longitudinal diameter of the elongated hole 17 along the tongue insertion direction.

The ejectors 40 are formed integrally on the bottom surfaces of the plate arms 56 respectively. The ejectors 40 are provided with guide grooves 41 formed on the sides thereof. The ejectors 40 are designed to be inserted to the ejector guide apertures 14 from the wide portions 14*a* by sliding the guide grooves along aperture edges 14*b* with the ejector springs being set to the ejectors 40. The inner aperture edges 14*b* of the ejector guide apertures 14 are each formed in an arch shape. Therefore the ejectors 40 integrally formed with the blocking plate 50 can slide in the tongue insertion direction even when the blocking plate 50 rotates only at a predetermined angle.

Further, the base plate 11 is provided with anti-false latching protrusions 18 formed at a predetermined distance away from each other. The anti-false latching protrusions 18 are made of parts of the base plate 11 by bending. When one of the tongue plates 31 is inserted, the blocking plate 50 rotates at a predetermined angle. The central protrusion 57 of the blocking plate 50 comes in contact with one of the anti-false latching protrusions 18, thereby restricting the rotational angle of the blocking plate 50.

Figure 11:
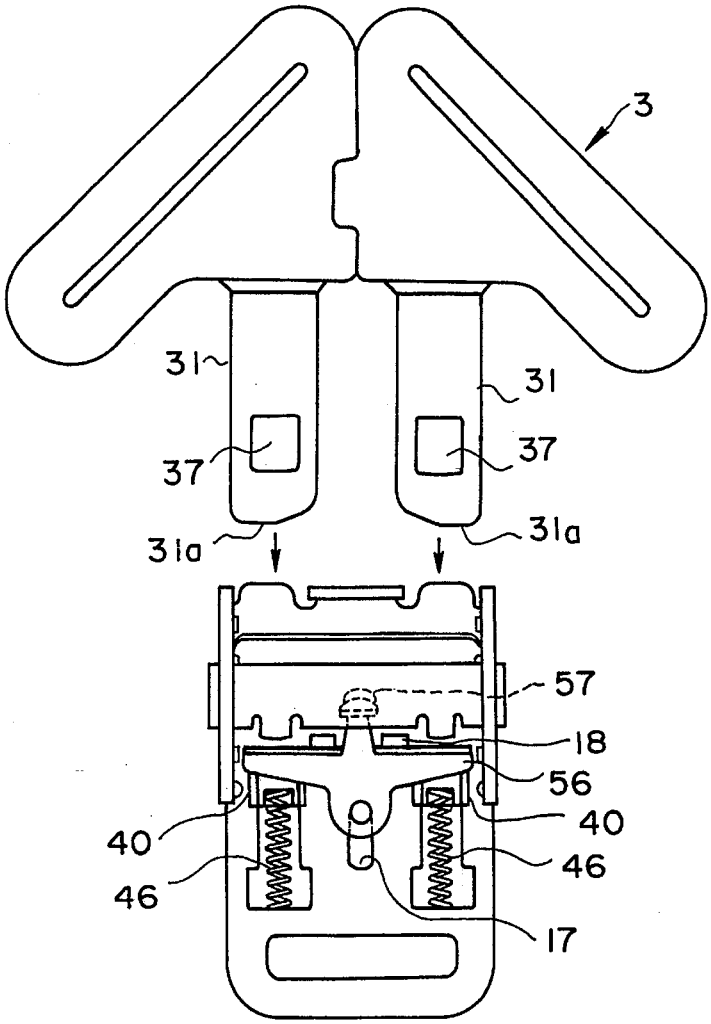
FIG. 11 is a view for explaining the operational state of the anti-false latching mechanism shown in FIG. 10 (before insertion of tongues)

FIG. 11 shows a state in which the tongues are not inserted. In this state, the right and left ejector springs 46 are equally expanded. The blocking plate 50 is positioned at the end of the elongated hole 17. Therefore, the plate arms 56 are in contact with the anti-false latching protrusions 18. The central protrusion 57 of the blocking plate 50 is positioned below the substantially central portion of the latch plate 20, thereby preventing the latch plate 20 from latching even though it is biased by the latch spring 61 in the latching direction.

Figure 12:
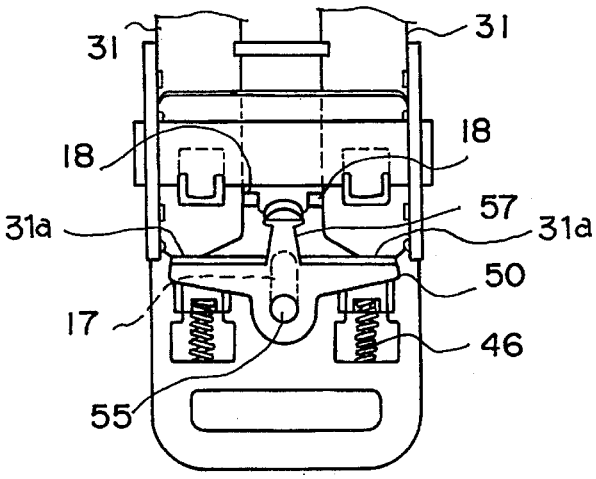
FIG. 12 is a view for explaining the operational state of the anti-false latching mechanism shown in FIG. 10 (after insertion of both of the tongues)

As shown in FIG. 12, the right and left tongues 3 and 3 are inserted through the tongue through holes (not shown) simultaneously. Then, the ends 31*a* of the tongue plates 31 and 31 equally push the ejectors 40 of the blocking plate 50 to compress the ejector springs 46. Therefore, the pin 55 slides rearwardly along the elongated hole 17 without rotation of the blocking plate 50 (see FIG. 12).

Figure 13:
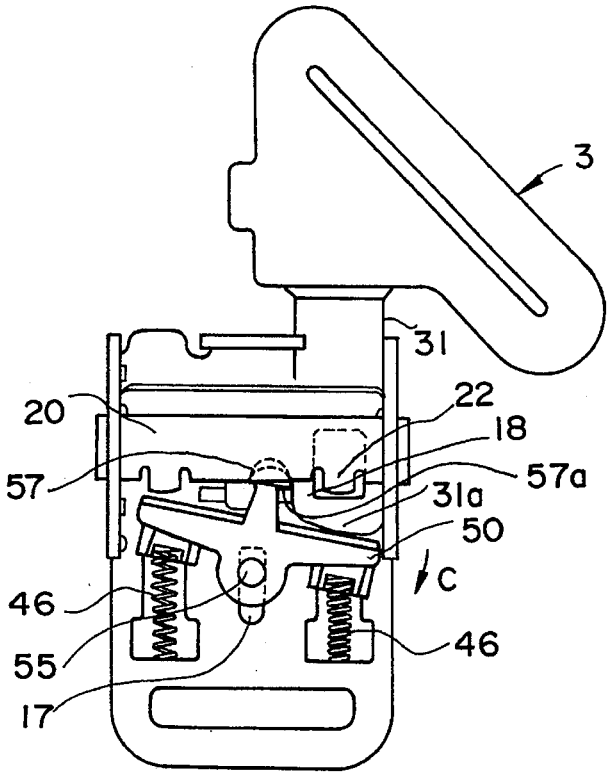
FIG. 13 is a view for explaining the operational state of the anti-false latching mechanism shown in FIG. 10 (after insertion of one of the tongues)

As shown in FIG. 13, in case where only one of the tongues 3 (the right tongue in FIG. 13) is inserted, the end 31*a* of the tongue plate 31 pushes only one of the ejectors 40 of the blocking plate 50. Then, the blocking plate 50 rotates in the direction of the arrow C and at the same time it slides along the elongated hole 17. At this point, a jaw 57*a* of the central protrusion 57 is in contact with the anti-false latching protrusion 18 so as to stop the sliding of the blocking plate 50. Therefore, the tongue S can not be inserted rearwardly from the position.

Further, the end of the central protrusion 57 is positioned below the latch plate 20, thereby restricting the pivotal movement of the latch plate 20. Therefore, the latch pawl 22 is prevented from latching to the engaging hole 37 of the tongue plate 31.

The description will now be made as regard to the mechanism for releasing the tongues from the latching with reference to FIG. 14.

Figure 14:
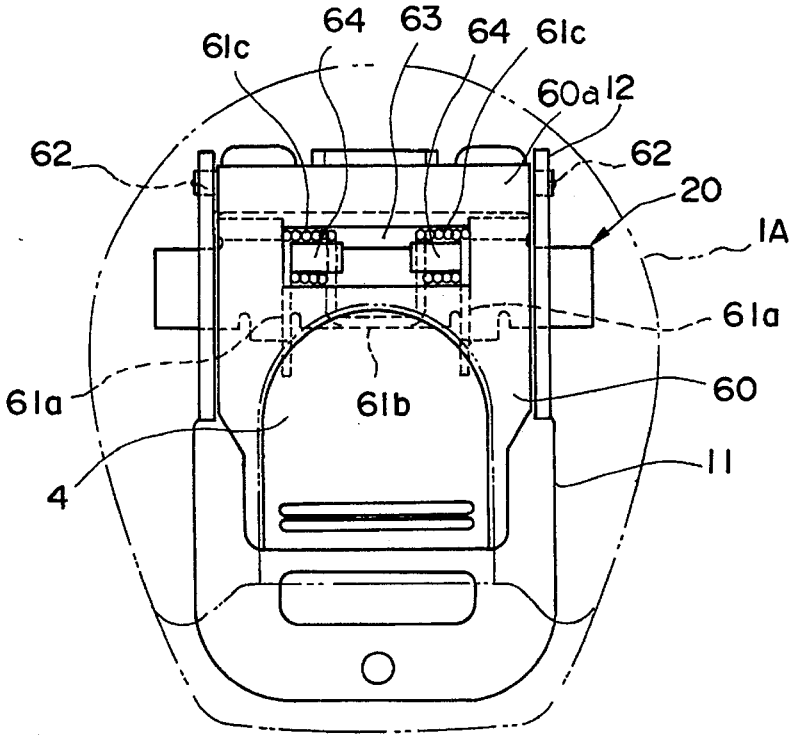
FIG. 14 is a front view showing parts of a tongue releasing mechanism of the buckle shown in FIG. 2.

As shown in FIG. 14, the button plate 80 is pivotally fitted to ends of the side plates 12 on both sides of the base plate 11. The button plate 60 comprises a push button 4 formed therein and is provided with shafts 62 on both upper ends thereof. The shafts 62 are supported in cutouts on the ends of the side plates 12.

The button plate 80 is provided with a rectangular cutout 63 formed substantially on the center and under the rotary axis thereof. Spring supporting projections 64, 64 are formed on both sides of the cutout 63. The button plate 60 is also provided with the convex push button 4 formed integrally in the lower half of the button plate 60. After an upper cover 1A is set, the top surface of the push button 4 becomes substantially flat relative to the surface of the upper cover 1A.

The reverse side of the button plate 60 is in contact with both sides of the latch spring 61 as a biasing member. The latch spring 61 is a torsion spring comprising a U-like portion 61*b* at the middle thereof and both ends 61*a* connected to the U-like portion 61*b* through coils 61*c* as shown in FIG. 14. The U-like portion 61*b*, the coils 61*c*, and the both ends 61*a* together form a V-like shape as shown in FIG. 15(*a*).

The both ends 61*a* of the latch spring 61 are accommodated in grooves formed in the back surface of the button plate 60. The U-like portion 61*b* is in contact with the substantially middle portion of the latch plate 20. The coils 61*c* are supported with the spring supporting projections 64 formed in the cutout 63 of the button plate 60. Therefore, there is no chance to separate the latch spring 61 from the other components during the assembly or disassembly.

Figure 15A:
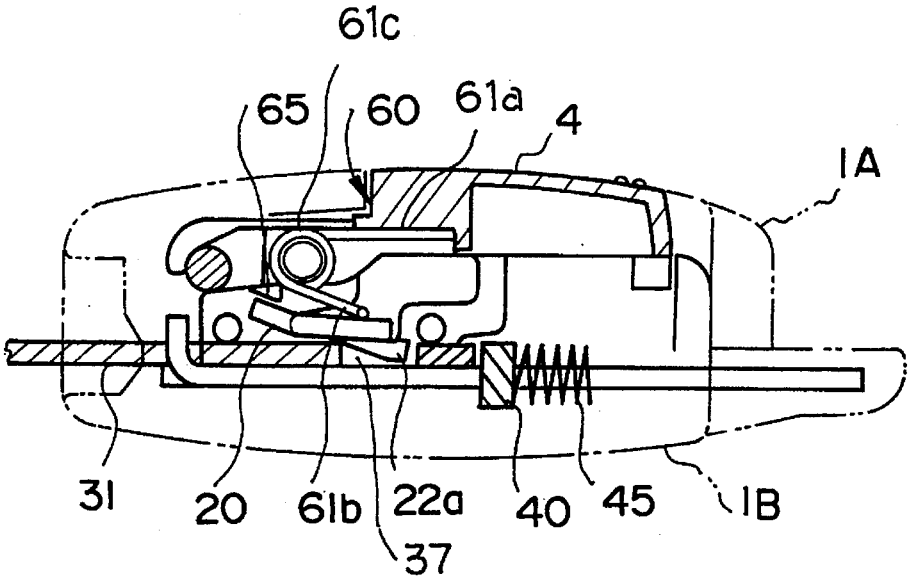
FIG. 15(*a*) and 15(*b*) are views for explaining the releasing operation of the buckle shown in FIG. 2 by the tongue releasing mechanism.
Figure 15B:
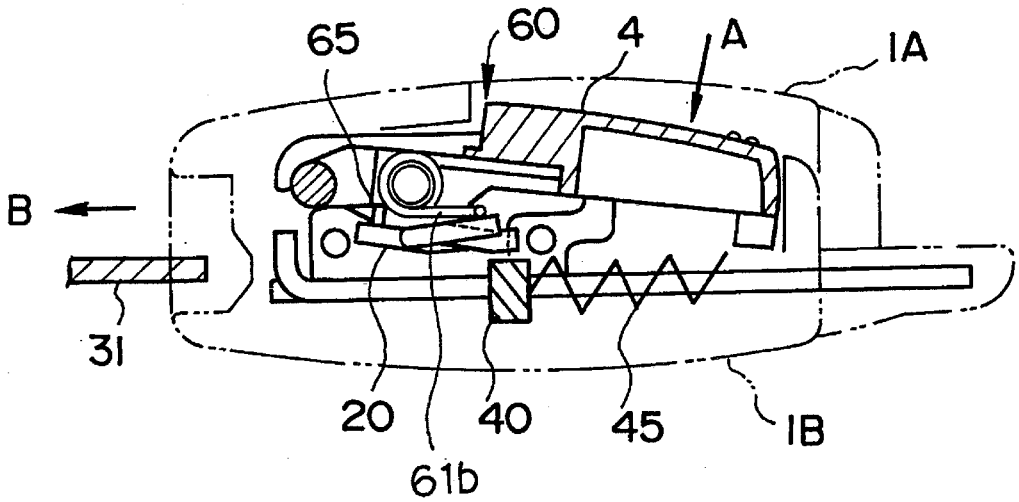

As shown in FIGS. 15(*a*) and 15(*b*), the button plate 60 is provided with triangular projections 65 formed on portions, in the lower side thereof, facing the latch plate 20. The triangular projections 65 come in contact with the surface of the latch plate 20 so as to pivot the latch plate 20 only at a predetermined angle.

It should be noted that, since the latch spring 61 generates balanced biasing force when the push button 4 is pressed, the button plate 60 which has been pressed can securely return to the initial position thereof.

Hereinafter, the operation in the buckle for releasing the tongues from the locking will be described referring to FIGS. 15(*a*) and 15(*b*).

FIG. 15(*a*) shows a state in which the tongue plates 31 are inserted into the buckle and the ejectors 40 slide to the most rear end. At this point, the U-like portion 61*b* of the latch spring 61 is in contact with the upper surface of the latch plate 20. By the biasing force applied from the U-like portion 61*b*, as shown in FIG. 15(*a*), the latch plate 20 is biased so that the ends 22*a* of the latch pawls 22 enter into the engaging holes 37. At the same time, the ejectors 40 slightly push back the tongue plates 31 by the biasing force of the ejector spring 46 so that the tongue plate 31 is held between the ejectors 40 and the latch pawls 22 of the buckle 1 without looseness.

In case where the tongues are incompletely engaged, the tongue plates 31 are prevented from false-latching by the operation of the blocking plate (not shown in this figure), as mentioned before.

For separating the tongue plates 31 from the buckle, as shown in FIG. 15(*b*), the push button 4 is pressed in the direction of the arrow A. At this time, the triangular projections 65 press the end of the latch plate 20. Thereby, the latch plate 20 pivots slightly upward to be substantially horizontal. Simultaneously, the end of the U-like portion 61*b* of the latch spring 61 is risen so as to retain predetermined biasing force in the latch spring. At the same time when the user takes his/her hand off the push button, the button plate 60 formed integrally with the push button 4 therefore returns in its initial state.

The tongue plates 31 are released from the engagement by the latch pawls 22 so that the tongue plates 31 are discharged in the direction of the arrow B by the biasing force of the ejector springs 45, with the result that the tongues are securely separated from the buckle.

The latch spring 61 is set to have a stiffness not to allow the operation when an infant presses the push button 4. Therefore, the tongues are hardly released only when the infant presses the push button for playing.

As apparent from the above description, according to the present invention, a pair of tongues can be securely latched to the buckle because the buckle is designed not to latch and lock when only one of the tongues is inserted thereto. In addition, since the buckle hardly releases the tongues except when the releasing operation is performed, it can provide a high safe buckle for a seat belt device for an infant.

What is claimed is:

1. A buckle device for an infant restraining seat comprising:

a frame member having a base plate and side plates;

an engaging member pivotally supported by supporting members formed in said side plates of said frame member, said engaging member being capable of engaging a pair of tongue plates inserted into said buckle;

a blocking plate rotatably supported on said base plate of said frame member substantially at the center in the width direction, said blocking plate having arms extending on both sides from near said center in the width direction and blocking members formed on ends of said arms for preventing the pivotal movement of said engaging member when said blocking plate rotates;

a pair of ejectors slidably supported by said frame member, said pair of ejectors disposed at positions to come in contact with said pair of tongue plates, respectively; and a pair of ejector springs each having two ends, one of said ends being fixed to the corresponding one of said arms of said blocking plate and the other end being fixed to a back surface of the corresponding one of said ejectors, said pair of ejector springs disposed between said arms and said ejectors in the compressed state; wherein when only one of said pair of tongue plates is inserted into said buckle, the pushing force by the insertion of said one of said tongue plates is transmitted to the corresponding one of said arms of said blocking plate through one ejector and one ejector spring, and said blocking plate rotates around said center by the pushing force so that either of said blocking members prevents the pivotal movement of said engaging member, thereby preventing engagement between said engaging member and said one of said tongue plates.

2. A buckle device for an infant restraining seat comprising:

a frame member having a base plate and side plates;

an engaging member pivotally supported by supporting members formed in said side plates of said frame member, said engaging member being capable of engaging a pair of tongue plates inserted into said buckle;

a blocking plate rotatably and slidably supported on said base plate of said frame member substantially at the center in the width direction, said blocking plate having arms, which extend on both sides from near said center in the width direction and have contact portions where the ends of said tongue plates come in contact with, and a blocking member for allowing the pivotal movement of said engaging member when said blocking plate moves slidably in the insertion direction of said tongue plates and for preventing the pivotal movement of said engaging member when said blocking plate rotates; and at least one ejector spring having two ends, one of said ends being fixed to said blocking plate and the other end being fixed to said base member, said ejector spring disposed for biasing said blocking plate in the discharge direction of tongue plates; wherein when only one of said pair of tongue plates is inserted into said buckle, the corresponding one of said arms of said blocking plate is pushed by the insertion of said one of said tongue plates, and said blocking plate rotates around said center by the pushing force so that said blocking member prevents the pivotal movement of said engaging member, thereby preventing engagement between said engaging member and said one of said tongue plates.

3. A buckle device for an infant restraining seat as claimed in claim 2, wherein said blocking member of said blocking plate is a protrusion protruding from said center of said blocking plate.

4. A buckle device for an infant restraining seat comprising:

a frame member having a base plate and side plates, said side plates having supporting members therein;

an engaging member disposed on the base plate and pivotally supported by the supporting members, said engaging member being capable of engaging a pair of tongue plates inserted into said buckle; and a blocking plate rotatably supported on said base plate, said blocking plate having at least one blocking member to be able to move under the engaging member at a side of the base plate for preventing pivotal movement of the engaging member so that when only one of the pair of the tongue plates is inserted into the buckle device, the blocking plate is rotated by the one of the tongue plate to place the at least one blocking member under the engaging member to thereby prevent engagement between the engaging member and said one of the tongue plates.

5. A buckle device for an infant restraining seat as claimed in claim 4, wherein said blocking plate includes two blocking members at both ends thereof, one of the blocking members being located under the engaging member when only one of the tongue plates is inserted into the buckle device.

6. A buckle device for an infant restraining seat as claimed in claim 5, further comprising means for resiliently supporting the blocking plate on the base plate, said resiliently supporting means being attached to the blocking plate so that the blocking member is prevented from moving under the engaging member unless one of the pair of the tongue plates is inserted into the buckle device.

* * * * *